US005111919A

United States Patent [19]

Hamatani et al.

[11] Patent Number: 5,111,919

[45] Date of Patent: May 12, 1992

[54] CONTAINER WITH INNER COMPARTMENT CASE

[75] Inventors: Tsutomu Hamatani, Toyama; Seihei Tomita, Tokyo, both of Japan

[73] Assignee: Yoshida Kogyo K.K., Tokyo, Japan

[21] Appl. No.: 723,380

[22] Filed: Jun. 28, 1991

[30] Foreign Application Priority Data

Jun. 28, 1990 [JP] Japan ..... 2-69455

[51] Int. Cl.[5] ..... A45C 11/00

[52] U.S. Cl. ..... 190/109; 190/903; 206/810

[58] Field of Search ..... 190/109, 903; 150/112; 206/810

[56] References Cited

U.S. PATENT DOCUMENTS

| | | | |
|---|---|---|---|
| 2,143,062 | 1/1939 | Ericson et al. | 190/109 |
| 2,245,999 | 6/1941 | Plotkin | 190/109 |
| 2,492,655 | 12/1949 | Rubin | 190/903 |
| 4,083,089 | 4/1978 | Minami | 190/903 |
| 4,703,519 | 10/1987 | Krenzel | 190/903 |
| 4,723,657 | 2/1988 | Robinson | 190/109 |
| 4,796,735 | 1/1989 | Horiuchi | 190/109 |
| 4,960,204 | 10/1990 | Young et al. | 190/109 |

FOREIGN PATENT DOCUMENTS

| | | | |
|---|---|---|---|
| 0044078 | 1/1982 | European Pat. Off. . | |
| 2342457 | 8/1974 | Fed. Rep. of Germany . | |
| 3537592A1 | 6/1986 | Fed. Rep. of Germany . | |
| 1253921 | 1/1961 | France | 190/109 |
| 432761 | 8/1935 | United Kingdom | 206/810 |
| 1552475 | 9/1979 | United Kingdom . | |

*Primary Examiner*—Gary E. Elkins

*Attorney, Agent, or Firm*—Hill, Van Santen, Steadman & Simpson

[57] ABSTRACT

A container has an inner compartment case, which is installed in the container body by a bend on a peripheral edge of a slide fastener support member, thereby covering a space between the container body and the inner compartment case. The inner compartment case is made by vacuum forming on a thermoplastic sheet, from which the inner compartment case is clipped to have a flat peripheral edge.

1 Claim, 4 Drawing Sheets

CONTAINER WITH INNER COMPARTMENT CASE

BACKGROUND OF THE INVENTION

1. Field of the Invention

This invention relates to a container having an inner compartment case suitable for neatly storing a video camera or a camera and its accessories, precise instruments such as vernier caliper gauges, or articles such as cosmetics, stationery, or bottles.

2. Description of Related Art

FIG. 7 of the accompanying drawings shows a conventional container having an inner compartment case. The container includes a container body 23, an inner compartment case 22 disposed in the container body 23 and having compartments 21 and a lid 24 for covering the container body 23. Both the container body 23 and the lid 24 are opened and closed by a slide fastener 25. The inner compartment case 22 includes a peripheral edge having a bend 26, which keeps the peripheral edge from being exposed out of the container so as to assure a good external appearance.

To make the inner compartment case having the bend 26 on the peripheral edge, a sheet of thermoplastic resin material is molded by vacuum forming, thereby producing a plurality of compartment cases at a time as shown in FIG. 8.

The molded compartment cases are cut from the thermoplastic sheet. Firstly, as shown in FIG. 9, the sheet is cut at portions A including margins around respective molded compartment cases. Then, the respective compartment cases are cut at portions B along the bends 26. These cutting processes are very complicated and troublesome. In addition, the amount of molding material is increased due to the existence of the bend 26, which causes an increase in the product cost.

To solve this inconvenience, it is conceivable to produce an inner compartment case having a flat peripheral edge instead of a bent peripheral edge. In such a case, however, there may be a space between the inner compartment case and the container. In addition, the peripheral edge of the inner compartment case may be exposed, adversely affecting the external appearance, and making the container less valuable.

SUMMARY OF THE INVENTION

It is therefore an object of this invention to provide a container with an inner compartment case which has an attractive external appearance and can be produced at a reduced cost.

According to this invention, there is provided a container comprising: a container body; an inner compartment case disposed in the container and having compartments and a flat peripheral edge; and a lid for covering an opening of the container, the lid being openable from the container body by a slide fastener. The slide fastener has a pair of stringers attached to the container and the lid by using a pair of forked support members. Each of the forked support members has an upper piece and a lower piece. At least the lower piece which is in contact with an inner peripheral edge of the container body has a bend at its edge which is in contact with the flat peripheral edge of the inner compartment case so as to cover a space between the container body and the inner compartment case.

With this arrangement, a pair of forked support members are used to attach the slide fastener around the peripheral edges of the container and the lid. Each of the forked support members includes the upper piece, and the lower piece which has the bend along its edge. The bend of the lower piece which is in contact with the inner peripheral edge of the container covers not only a space between the container and the inner compartment case but also the peripheral edge of the inner compartment case.

The above and other advantages, features and additional objects of this invention will be manifest to those versed in the art upon making reference to the following detailed description and the accompanying drawings in which one preferred embodiment incorporating the principles of this invention is shown by way of an illustrative example.

DETAILED DESCRIPTION

Figure 1:
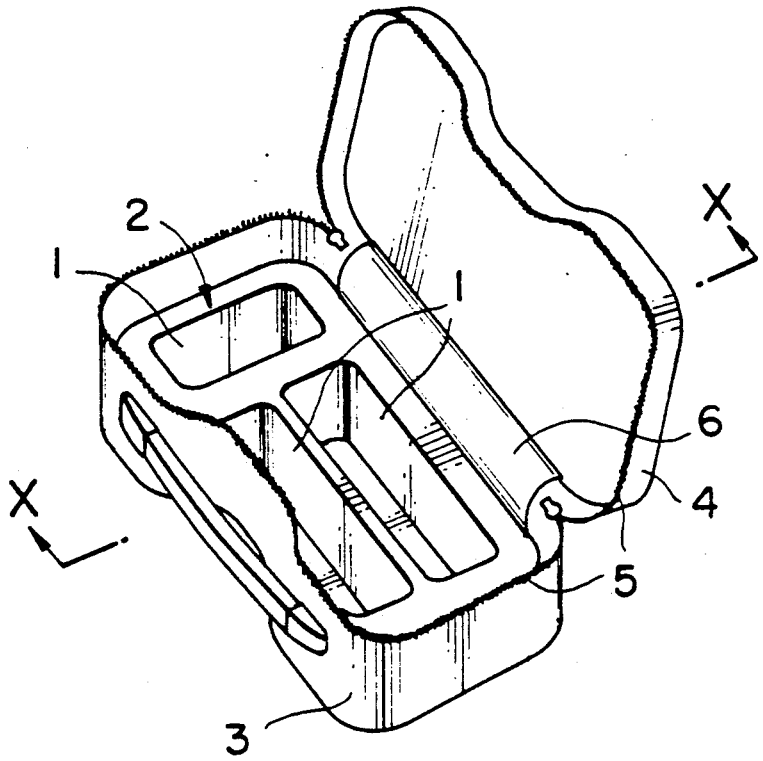
FIG. 1 is a perspective view of a container with an inner compartment case according to one embodiment of this invention.

FIG. 1 shows a typical example of a container having an inner compartment case according to one embodiment of the invention. The container includes a container body 3, an inner compartment case 2 disposed in the container body 3 and having compartments 1 for storing articles, and a lid 4 for covering the container body 3 and being openable by a slide fastener 5. In FIG. 1, reference numeral 6 stands for a shield cloth.

Figure 2:
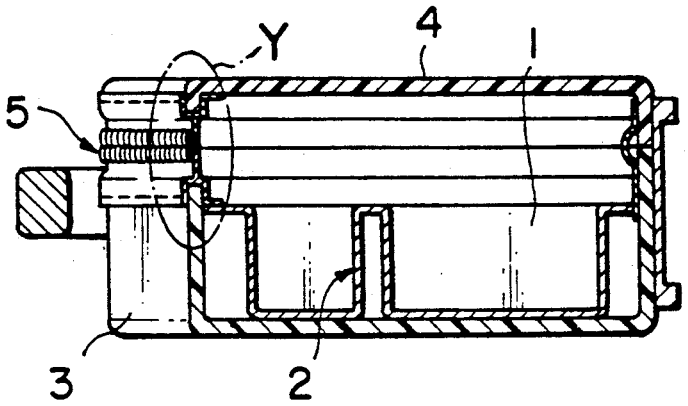
FIG. 2 is a cross-sectional view of the container taken along the line X—X of FIG. 1.
Figure 3:
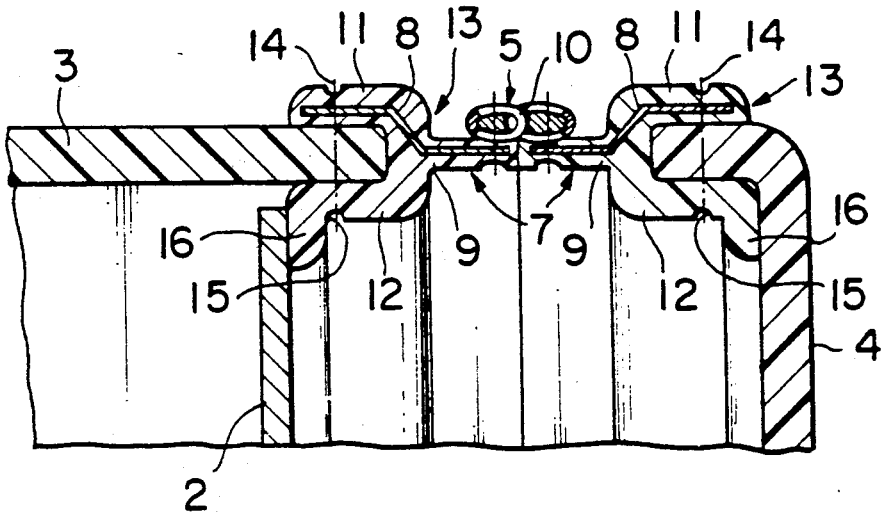
FIG. 3 is an enlarged cross-sectional view taken along the line Y—Y of FIG. 2.
Figure 4:
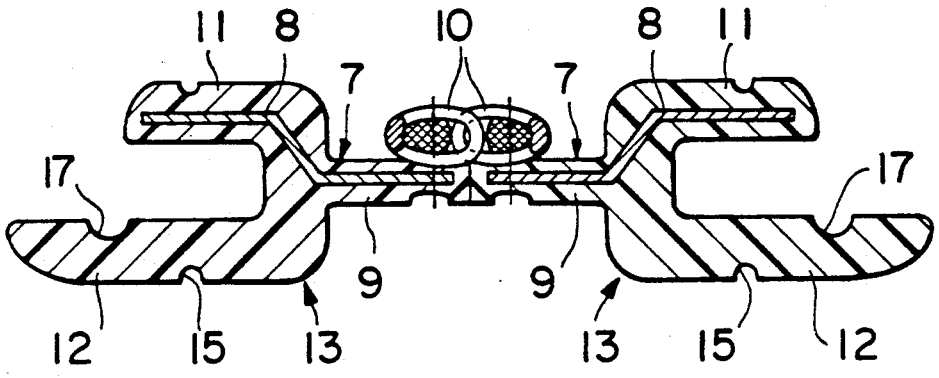
FIG. 4 is a cross-sectional view of a slider fastener to be used for the container.

Base cloth 8 of each slide fastener tape 7 is coated by a film 9 of an elastic material such as synthetic resin or rubber. Slide fastener coupling elements 10 are attached on the edge of the fastener tape 7. A pair o stringers of the slide fastener 5 are attached to the peripheral edges of the container body 3 and lid 4 by a pair of forked support members 13. As shown in FIGS. 2 to 4, each of the forked support members 13 has an upper piece 11 and a lower piece 12. The peripheral edge of the container body 3 is inserted into a space between the upper and lower pieces 11, 12 of one of the forked support members 13, while the peripheral edge of the lid 4 is similarly inserted into a space between the upper and lower pieces 11, 12 of the other forked support member 13. Then the slide fastener 5 and the container body 3 are sewn by a thread 14 in slits 15 on the upper and lower pieces. The lid 4 and the slide fastener 5 are also similarly sewn. The base cloth 8 is sandwiched in the upper piece 11 of the forked support member 13.

Both of the upper pieces 11 are substantially flush with or higher than the top of the slide fastener coupling elements so as to prevent the coupling elements from being damaged.

Each of the lower pieces 12 in contact with the inner peripheral edge of the container body 3 (or the lid 4) has a bend 16. The bend 16 is in elastic contact with a peripheral edge of the inner compartment case 2 (or the inner peripheral edge of the lid 4). As shown in FIG. 4, each of the lower pieces 12 has a slit 17 on its side in contact with the inner surface of the container body 3 (or the lid 4) so as to facilitate formation of the bend 16.

Figure 5:
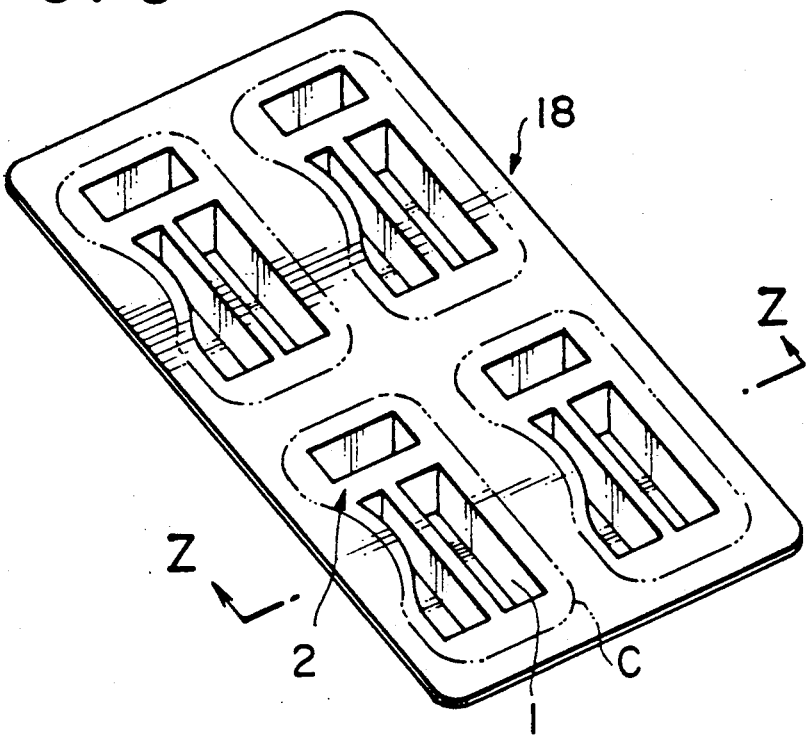
FIG. 5 is a cross-sectional view of one example of a molded inner compartment case for the container.
Figure 7:
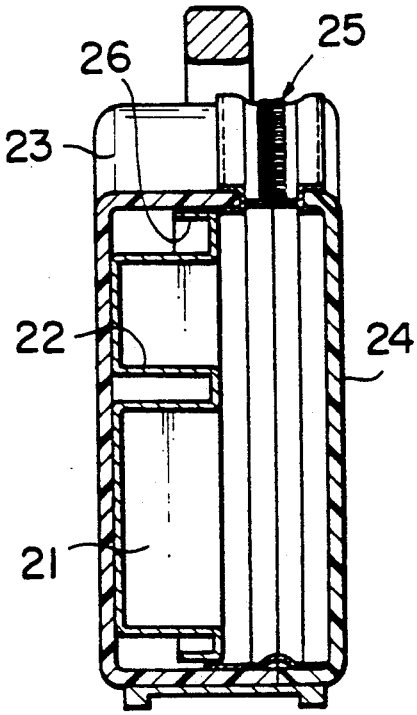
FIG. 7 (PRIOR ART)
FIG. 7 is a cross-sectional view showing one example of a conventional container with an inner compartment case.
Figure 6:
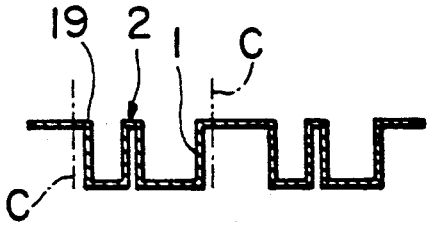
FIG. 6 is a cross-sectional view taken along the line Z—Z of FIG. 5.
Figure 8:
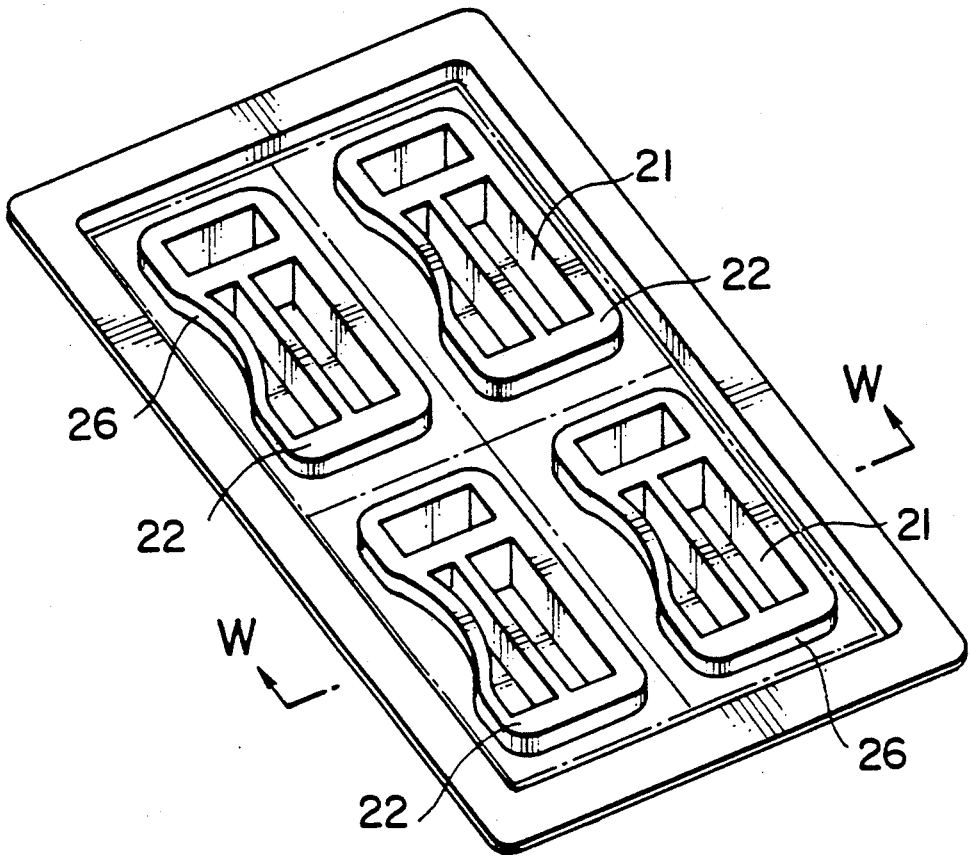
FIG. 8 (PRIOR ART)
FIG. 8 is a cross-sectional view showing a molded inner compartment case for the conventional container.
Figure 9:
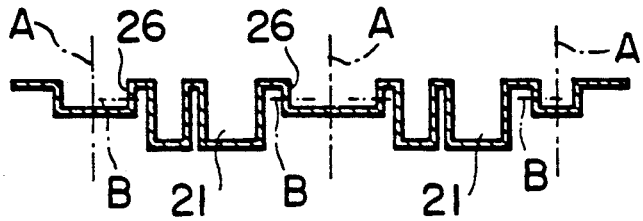
FIG. 9 (PRIOR ART)
FIG. 9 is a cross-sectional view taken along the line W—W of FIG. 8.

FIG. 5 shows a molding 18 of four inner compartment cases, which is made by vacuum forming on a thermoplastic sheet such as rigid vinylchloride or polyethylene. The molding 18 is flat except for concave compartments, and is clipped in one process as shown by the double-dot lines C, making respective compartment cases 2. Each of the clipped compartment cases 2 has a flat peripheral edge 19.

According to this invention, the flat peripheral edge of the inner compartment case is in contact with the bend of the lower piece of the forked supper member, thereby covering the space between the container and the inner compartment case, keeping the peripheral edge of the inner compartment case unexposed, and improving the external appearance of the container. Each of the molded inner compartment cases can be clipped from the base material by one easy and simple process compared with the two clipping processes required for the conventional inner compartment cases. In addition, the inner compartment cases can be made of a reduced amount of base material, enabling the inner compartment cases to be less expensive than conventional ones.

What is claimed is:

1. A container comprising:

(a) a container body;

(b) an inner compartment case having compartments and a flat peripheral edge and being disposed in said container body;

(c) a lid for covering an opening of said container body; and (d) a slide fastener for opening and closing the lid, said slide fastener including a pair of stringers attached to said container and said lid by using a pair of forked support members sandwiching respective tapes of said stringers, each said forked support member having an upper piece and a lower piece, and at least said lower piece which is in contact with an inner peripheral edge of said container body having at its edge a bend which is in contact with said flat peripheral edge of said inner compartment case so as to cover a space between said container body and said inner compartment case.

* * * * *